United States Patent [19]

Kratzsch et al.

[11] Patent Number: 4,692,365

[45] Date of Patent: Sep. 8, 1987

[54] USE OF AIR-JET TEXTURED YARNS IN THE MANUFACTURING OF ABRASIVES ON SUBSTRATES

[75] Inventors: Eberhard Kratzsch, Wuppertal; Wolfgang Cygan, Erkrath; Nandor Kiss, Wuppertal, all of Fed. Rep. of Germany

[73] Assignee: Akzona Incorporated, New York, N.Y.

[21] Appl. No.: 666,522

[22] Filed: Oct. 30, 1984

[30] Foreign Application Priority Data

Nov. 4, 1983 [DE] Fed. Rep. of Germany ..... 3339911

[51] Int. Cl.[4] ..... B32B 3/02

[52] U.S. Cl. ..... 428/87; 51/298; 57/246; 428/85; 428/97; 428/224; 428/229; 428/240; 428/253; 428/297

[58] Field of Search ..... 51/298; 428/85, 87, 428/97, 240, 253, 297, 224, 229; 57/246

[56] References Cited

U.S. PATENT DOCUMENTS

| | | | |
|---|---|---|---|
| 4,338,776 | 7/1982 | Krenzer | 57/246 |
| 4,437,269 | 3/1984 | Shaw | 51/298 |
| 4,474,585 | 10/1984 | Gruber | 51/298 |
| 4,501,046 | 2/1985 | Krenzer | 57/246 |
| 4,519,200 | 5/1985 | Phillips | 57/246 |

*Primary Examiner*—James J. Bell

*Attorney, Agent, or Firm*—Tom R. Vestal; Jeffrey S. Boone

[57] ABSTRACT

Use of a textured polyester filament yarn in a substrate for the manufacture of abrasives is disclosed. The substrate permits the manufacture of abrasives having a uniform and clean surface and a long running time. Coated abrasives incorporating the invention will not rapidly lose their binding agent grain layer during grinding and possess a high level of adhesion between substrate and adhesive. The particular yarn disclosed exhibits good absorbency for a binding agent for all, including fine, grains of abrasives.

14 Claims, No Drawings

USE OF AIR-JET TEXTURED YARNS IN THE MANUFACTURING OF ABRASIVES ON SUBSTRATES

BACKGROUND OF THE INVENTION

In the abrasives industry, "abrasive on a substrate" is the collective designation for numerous products consisting of a flexible substrate coated with abrasive grains. It corresponds to the designation "coated abrasives" used in most English-speaking parts of the world.

"Abrasives on a substrate" utilizing polyester yarns have been known for some time. For example, in Canadian Pat. No. 676,601, coated abrasives are described, wherein the substrate consists of a woven fabric. Such a woven fabric may consist of yarns of a varied number of polymers, including polypropylene, polyethylene and polyesters.

While the Canadian reference No. 676,601 mentions that woven substrate fabrics can be made of filament yarns, preference is given to polyester staple fibers, since fabrics of this material are better able to absorb enough abrasive grain and to provide adequate adhesion of the grain to the substrate. When using yarns of smooth continuous polyester filaments, one does indeed obtain relatively uniform substrates, but the adhesion of the grain in the substrate leaves much to be desired. Efforts have been made, therefore, to obtain a more staple fiber-like nature in filament yarns by modifying the structure thereof to obtain the advantages of continuous filament yarns in the manufacture of substrates with advantages possessed by staple fibers.

In German Pat. No. 3,218,441, various kinds of filament yarns are referred to which may serve in the manufacture of a supporting fabric used in a coated abrasives substrate. The yarns may consist of filaments having a non-circular, e.g., a triangular, cross section. Reference is also made to fibers having lateral extensions along the length of the fiber as spacing elements without explaining how those lateral extensions are to be shaped in the fiber. Reference is also made to crimped polyester filament yarns without indicating processing conditions on how to obtain the crimp for satisfactory performance as a substrate.

Furthermore, in Example 5 of this reference, it is shown in a comparison example that falsetwist textured yarns are disadvantageous for the manufacture of substrates because loops solidified with an impregnating agent protrude from the surface in a manner that abrasives manufactured with the substrate lose the binding agent grain layer after a grinding time of a few minutes.

As a consequence, until now, there has been an unfulfilled demand for a textured polyester filament yarn which can be used advantageously in the manufacture of abrasives in a substrate in such a manner that it is possible to obtain abrasives having a uniform and clean surface and a long running time; which further will not rapidly lose their binding agent grain layer during grinding; and which, beyond that, possess a high level of adhesion between substrate and abrasive grain, even in the range of fine grains; and also exhibits a substrate which exhibits a good absorbency for the binding agent used in coated abrasives.

BRIEF DESCRIPTION OF THE INVENTION

It is, therefore, a goal of the present invention to utilize textured polyester filament yarns accordingly described herein to manufacture abrasives on a substrate which do not possess the mentioned disadvantages above for filament yarn, and, on the other hand, excel in the advantages above listed for staple fiber yarns.

The present invention makes use of textured polyester filament yarns which are air-jet textured and heatset. Further, the yarns possess loops and bows, of which at least a part are freely protruding. Preferably, the yarns used exhibit between 10 to 80 protruding loops and bows per running centimeter of yarn, forming freely protruding fiber ends. The loops and bows may be partly opened at their outer reaches. Preferably, the hot air shrinkage of the yarns utilized herein is at most 6%, preferably in the order of 2% or less. Further, the boiling shrinkage of the yarn is preferably between 0.5 and 4%.

In one embodiment, the yarns utilized in the invention are subjected to falsetwist texturing at a low number of turns prior to being air-jet textured. The yarns are then heatset. Yarns of this invention may have a total denier of 100 to 1200 decitex. Decitex, or dtex, is a measure of yarn size expressed in gram weight of 10,000 meters of the yarn.

The level of falsetwist texturing of the yarns may be between 1200 and 1800 turns per meter, with the twist setting temperature during falsetwist texturing being in a range of 180° C. to 225° C. Such yarns may be used either in an untwisted state to form substrates, or may have a protective twist of 80 to 400 turns per meter inserted therein.

In one particular form of manufacture of the yarns herein, the yarns, before being heatset, but after air jet texturing, may be guided over one or several rotatably mounted rolls located one behind the other in the direction of yarn travel, with the yarns making at least one turn on the rolls in such a way that the bundle of ends being supplied to the rolls covers the bundle of ends unwinding from the rolls at least in its fringe or outer surface area. In this manner, the loops and bows of an unwinding yarn bundle are captured by the oncoming yarn in such a manner to enhance their protrusion from the outwardly travelling yarn and form freely protruding fiber ends by breaking or tearing them. The rolls used herein may have a roughened surface to better grasp the yarn for this purpose.

Within the context of the invention herein, woven substrates utilizing textured polyester filament yarns described herein are highly suitable for abrasives. It is also advantageous if the substrate is a pile fabric—in particular a stitch reinforced knitted pile fabric.

It is also expedient if the individual filament denier amounts to between 0.5 to 2.5 decitex. Yarns used pursuant to the invention may be of mixtures of different deniers or different cross-sections.

A number of examples of air jet texturing of polyester filament yarns are in existence. For example, a device by which air jet textured yarns can be manufactured is described in the magazine *Chemiefasern/Textile-Industrie* of October 1975, beginning at page 929.

DETAILED DESCRIPTION OF THE INVENTION

Within the framework of the present invention, it is preferable to make air jet textured yarns of polyester filaments which have been textured according to the process described in U.S. Pat. No. 4,338,776. Reference is made expressly herein to the disclosure in this publication. In this particular process, which is used for the manufacture of crimped yarn of continuous multifilament fibers, the yarn is driven between a first and a second delivery system, in between which exists a texturing jet functioning according to the air jet texturing principle. The speed $V_2$ of the second delivery system is slower than the speed $V_1$ of the first delivery system. After leaving the texturing zone, the yarn is subjected to a heatless drafting step in a stabilizing zone. The drafting in the stabilizing zone does not lead to elastic or plastic deformation. Following the stabilizing zone, the yarn is fed to a setting zone, in which shrinkage and heat treatment of the yarn is conducted. Heat treatment temperatures may be up to 245° C., with the speed exiting the treatment zone being less than the initial or first delivery speed $V_1$. The yarn thereafter is wound onto a spool at a predetermined yarn tension and a winding speed which also is less than the initial or first delivery speed $V_1$.

A process for the partial tearing or opening of loops and bows of polyester filament yarns, as just described, is contained in U.S. Pat. No. 4,501,046. Express reference is made herewith to this disclosure.

The yarns prepared according to the above-described process should exhibit loops and bows which in part protrude beyond the periphery of the yarn. Such yarns, provided they are set in a suitable manner, can be used in the present invention. However, in order to make them especially suitable herein, the yarns are preferably guided with at least one turn around one or several rotatably mounted rolls located one behind the other in the direction of the yarn travel. Yarns fed in a series of rolls in this manner tend to trap loops and bows protruding beyond the core of the unwinding bundle. As the incoming yarn to the roll temporarily captures the loops and bows in this manner, a number of the bows will be broken or torn. Such yarns may be subsequently thermally stabilized in hot dry air having temperatures on the order of 180° C. to 200° C. It is also permissible to set the yarn in saturated steam.

In an especially advantageous version of this invention, polyester filament yarns are subjected to a low-level twist falsetwist texturing step before being air textured. The most suitable number of turns depends upon the total denier of the yarn to be treated. For example, for deniers from 100 to 1200 dtex, according to the invention herein, the number of turns may be from 1200 to 1800 turns per meter. Further, in this particular version, a temperature of 180° C. to 225° C. is preferably maintained in the twist setting zone of the falsetwist texturing step. Yarns textured in this manner may then be air tangled and set in the manner above described.

"Substrates" within the context of this invention is understood to include flat, shaped articles such as nonwovens, woven or knitted fabrics, and the like which make use of appropriate adhesive agents. If required, additional customary additives can be coated or loaded with customary abrasives herein. The substrates can be made up in the form of strips, ribbons, mats, etc., and they also consist of specially made up flat shaped articles such as discs or the like. Fabrics can be constructed in customary weaves, and the weight of the fabrics may vary, for example, between 150 to 500 grams per square meter. The same or different deniers of yarns may be used in the warp and filling of woven fabrics.

The substrate may consist of a single flat shaped textile article. It is also possible to combine two or more kinds of flat shaped articles in the manufacture thereof.

In one embodiment, the yarns in the substrate may be in the form of a pile material. By pile material, it is meant any textile fabric in which the yarns, due to the manufacturing process, form projections, e.g., tufts. The piles may be open or closed.

Suitable designs of pile materials usable as substrates are referred to in German Registered Design Rule No. 82 37 962.1 on page 4. Reference is expressly made herein to this German registered design. Stitchery-reinforced knitted substrates or substrates with an appropriate filling are highly suitable.

The substrates manufactured in accordance with the invention herein have a smooth surface noticeable in the finished abrasive, and have a long running time and operation. Results generally obtained only with staple fiber yarns may be obtained through this particular invention, while still retaining the advantages of continuous filament yarn manufacture. The special structure of the yarns permits the substrate manufactured therewith to be very absorptive of binding agents, permitting the latter to penetrate into the interior of the substrate, guaranteeing a good adhesion of the grain thereto. Substrates manufactured in accordance with the invention herein exhibit excellent mechanical characteristics—in particular, strength, tear resistance, and low relative elongation, especially in the case of woven fabrics. Special advantages of cleanliness and surface adhesion are obtained with fine grain abrasives utilizing the substrate described herein and may be used in wet as well as dry grinding processes.

What is claimed is:

1. A coated abrasive comprising a substrate having an abrasive agent thereon; wherein said substrate has been formed from a polyester filament yarn which has been air-jet textured and heatset, and which has loops and bows, of which at least a part of the loops and bows are freely protruding from the core of the yarn.

2. The coated abrasive of claim 1, wherein the yarn contains between 10 and 80 freely protruding loops and bows per centimeter of yarn length.

3. The coated abrasive of claim 1, wherein part of the loops and bows of the yarn are partly open or torn, forming freely protruding fiber ends.

4. The coated abrasive of claim 1, wherein the yarn has a hot air shrinkage of less than about 6%.

5. The coated abrasive of claim 4, wherein the hot air shrinkage is less than about 2%.

6. The coated abrasive of claim 1, wherein the boiling shrinkage of the yarn is about 0.5 to 4%.

7. The coated abrasive of claim 1, wherein the yarn, prior to airjet texturing and heatsetting, has been falsetwist textured at a low level of turns.

8. The coated abrasive of claim 7, wherein the yarn has a total denier of from about 100 to 1200 dtex, and which has been subjected to falsetwist texturing at a level of 1200 to 1800 turns per meter, and wherein the twist setting temperature during falsetwist texturing was from 180° C. to 225° C.

9. The coated abrasive of claim 8, wherein the yarn is substantially without twist.

10. The coated abrasive of claim 8, wherein the yarn has a protective twist of 50 to 400 turns per meter.

11. The coated abrasive of claim 1, wherein, prior to heatsetting, the yarn has been guided over at least one rotatably mounted roll with at least one full turn in a maner that the loops and bows protruding from the travelling yarn on the roll are captured by the oncoming yarn as it is fed onto the roll to open or tear the loops and bows and thereby form protruding fiber ends on the yarn.

12. The coated abrasive of claim 1, wherein the substrate is a woven material.

13. The coated abrasive of claim 1, wherein the substrate is a pile material.

14. The coated abrasive of claim 1, wherein the substrate is a stitch-reinforced knitted fabric.

* * * * *